US011970803B2

(12) United States Patent
Yang

(10) Patent No.: US 11,970,803 B2
(45) Date of Patent: Apr. 30, 2024

(54) METHOD OF ATTACHING A ZIPPER

(71) Applicant: EOSEN LLC, Monterey Park, CA (US)

(72) Inventor: Zijiang Yang, Fontana, CA (US)

( * ) Notice: Subject to any disclaimer, the term of this patent is extended or adjusted under 35 U.S.C. 154(b) by 264 days.

(21) Appl. No.: 17/703,748

(22) Filed: Mar. 24, 2022

(65) Prior Publication Data

US 2023/0304205 A1 Sep. 28, 2023

(51) Int. Cl.
*D05B 93/00* (2006.01)
*A45C 13/10* (2006.01)
*D05B 35/06* (2006.01)

(52) U.S. Cl.
CPC ..... *D05B 93/00* (2013.01); *A45C 13/103* (2013.01); *A45C 13/1023* (2013.01); *D05B 35/064* (2013.01)

(58) Field of Classification Search
CPC ... D05B 1/26; D05B 1/18; D05B 3/12; D05B 3/22; D05B 93/00; D05B 93/02; A45C 13/103; A45C 13/1023; A44B 19/40
USPC ..... 112/475.16, 406, 440, 441
See application file for complete search history.

(56) References Cited

U.S. PATENT DOCUMENTS 3,561,073 A * 2/1971 Rosser ..... A41H 37/003 2/265
3,605,665 A * 9/1971 Donald ..... A41H 37/003 112/475.16
4,628,545 A * 12/1986 Metzler ..... A41H 37/003 2/265
4,704,781 A * 11/1987 Frohlich ..... D05B 35/064 112/475.16
4,892,049 A * 1/1990 Hiramatsu ..... D05B 35/064 112/475.16
4,996,933 A * 3/1991 Boser ..... D05B 35/064 112/152
5,806,450 A * 9/1998 Dudek ..... D05B 35/064 112/113
6,164,227 A * 12/2000 Itoh ..... A41D 27/24 112/475.16
2011/0041247 A1* 2/2011 Moon ..... A47G 9/02 5/490
2012/0246888 A1* 10/2012 Matsushima ..... A44B 19/406 112/475.16
2012/0246889 A1* 10/2012 Matsushima ..... A41H 37/003 24/430
2014/0359979 A1* 12/2014 Gonda ..... A44B 19/32 112/475.16
2023/0062734 A1* 3/2023 Meersschaert ..... A45C 13/04

FOREIGN PATENT DOCUMENTS

CN 215014105 U * 12/2021
EP 2710916 A1 * 3/2014 ..... A45C 13/103

* cited by examiner

*Primary Examiner* — Danny Worrell

(57) ABSTRACT

A method of attaching a zipper (42) to a carrying case (40) to define an interior compartment or pocket (60). Opposed edges (52, 54) of a single piece of material (50) are folded under and are sewn to respective top (62) and bottom (64) surfaces of a tape (48) of the zipper to form a double layer of the material (58) extending from the zipper. A fold line (56) is formed in the double layer of material, and the fold line is sewn to the body (44) of the case. Stitching steps are minimized, no raw edge is exposed to the interior volume, and the double layer of material provides strength.

15 Claims, 2 Drawing Sheets

METHOD OF ATTACHING A ZIPPER

FIELD OF THE INVENTION

This invention relates generally to the attachment of a zipper to a product, for example when forming a pocket or main closure of a carrying case.

BACKGROUND OF THE INVENTION

Carrying cases of all types are well known in the art, including products such as suitcases, briefcases, bags, backpacks, pouches, and carrying conveyances for various specialty products such as computers, wine, guns, etc. It is common for such carrying cases to include one or more zippers for providing alternatively the enclosure of, or access into, a central volume or pocket of the case. The opening and closing of a zipper induces mechanical stresses into the case which, over time, may result in the tearing of the case material or disengagement of the attachment of the zipper to the case.

To provide adequate mechanical strength, a stitching process is often used to attach a zipper to a case using two layers of material. FIG. 1 illustrates a known construction for attaching a zipper 10 to a case 12, for example when constructing a side pocket or main closure of the case. The zipper 10 is formed to have teeth 14 attached to a tape 16. The zipper 10 is attached to a wall or body 18 of the case 12 by two pieces of material to provide strength; an upper layer of material 20 and a lower layer of material 22. Raw edges 24, 26 may be folded under to provide a clean exterior look before or after the upper 20 and lower 22 pieces are sewn to respective top 28 and bottom 30 surfaces of tape 16. The two pieces of material 20, 22 extending away from the zipper 10 are sewn together remote from the zipper 10 with a first set of stitching 32, and then are sewn to the body 18 with a second set of stitching 34. The raw edges 36, 38 of the material are typically folded under prior to the second set of stitching 34 to provide a better appearance for the exterior of the product.

The present invention recognizes that the prior art method of FIG. 1 requires the measuring and cutting of two pieces of material, then the additional step of sewing those two pieces together at the body end prior to attaching both pieces to the body of the case. The prior process also leaves raw edges exposed, increasing the possibility of fraying and failure of the material over time. Moreover, that arrangement places the joinder of the two pieces of material at a location of high stress intensity when the zipper is being used.

SUMMARY OF THE INVENTION

To address the limitations of the prior art, the present invention utilizes only a single piece of material to attach a zipper to a case, but does so in a manner that still provides a strong mechanical attachment, while at the same time reducing the number of assembly steps and the cost of manufacturing a carrying case product. Opposed ends of a single piece of material are attached to the tape of a zipper to form a double layer of material extending away from the zipper. A fold line is formed in the double layer of material, which is then attached to the case, such as with a single line of stitching.

In particular, a method of attaching a zipper to a case according to the invention comprises:

- providing a single piece of material having opposed first and second raw edges;
- folding the first raw edge of the material to create a clean top edge;
- folding the second raw edge of the material to create a clean bottom edge;
- attaching the clean top edge to a top surface of a tape of a zipper and the clean bottom edge to a bottom surface of the tape of the zipper, thereby creating a double layer of the material extending away from the zipper;
- folding the double layer of material along a fold line remote from the zipper; and
- attaching the double layer of material to a body of a case proximate the fold line to at least partially define an interior volume of the case.

The inventive method results in no raw edge being present at the point of attachment of the double layer of material to the case, thereby eliminating the chance of fraying of raw edges as has been experienced in the prior art. The inventive method requires only one piece of joining material and the prior art step of attaching the ends of two pieces of material to each other prior to attaching them to the case is eliminated. Moreover, a single folded piece of material is stronger than the joinder of two separate pieces of material as is used in the prior art.

An exemplary embodiment of the invention is described more fully in the detailed description below and in the accompanying drawings.

DETAILED DESCRIPTION OF THE INVENTION

Figure 2:
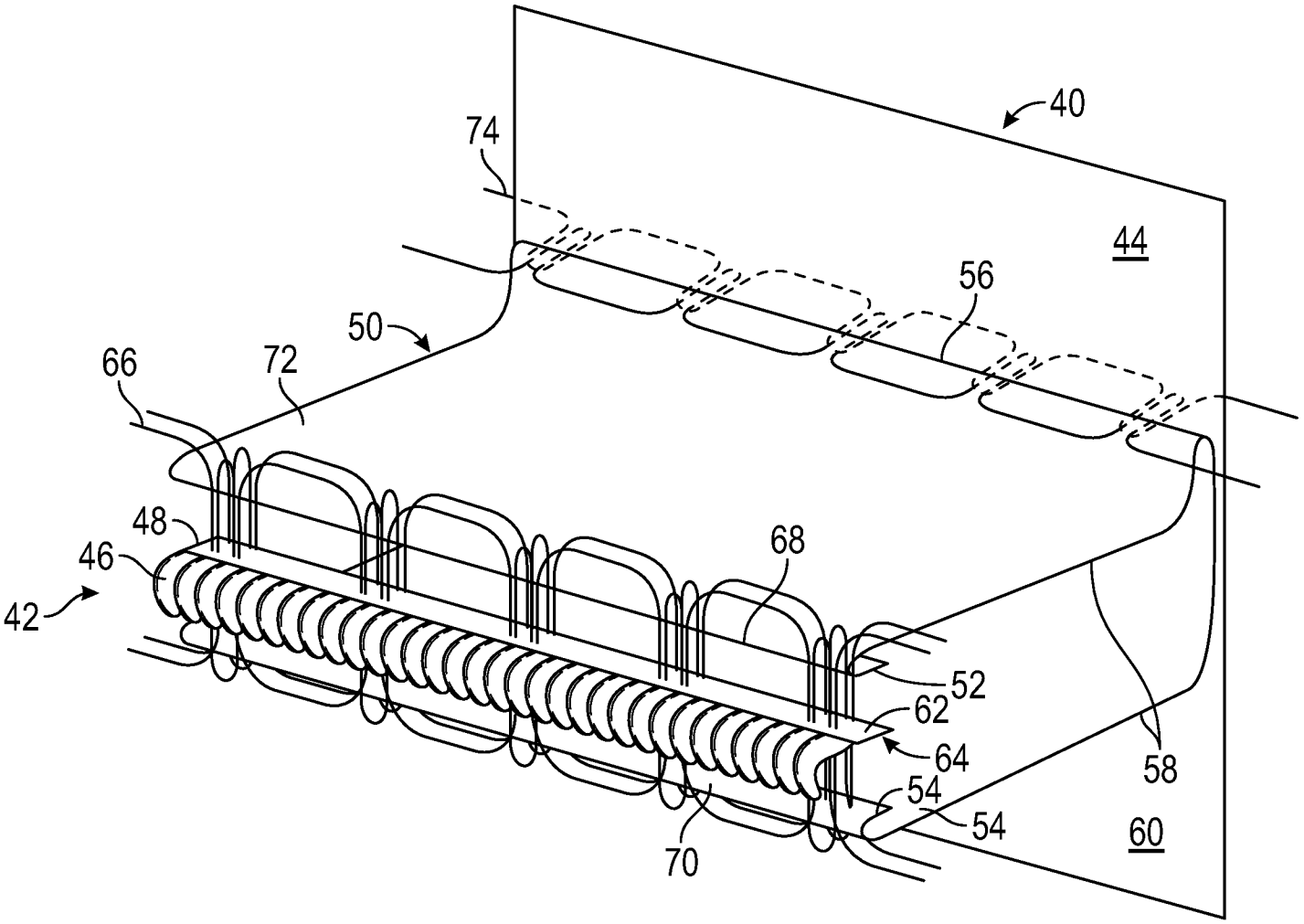
FIG. 2 illustrates the attachment of a zipper to a case in accordance with an embodiment of the invention.

FIG. 2 illustrates an improved method of attaching a zipper to a carrying case. The zipper may be a closure for a main storage volume of the case, or it may be a closure for an external component of the case, such as a side pocket.

Carrying case 40 may be any known style of conveyance such as, but not limited to, a purse, duffle bag, pouch, suitcase, gun case, briefcase, etc. A zipper 42 is attached to a portion of the body 44 of the case 40, for example a side wall of the case 40. As is common in the art, zipper 42 is formed to have interconnecting sets of teeth 46 which are supported by a tape 48. Zipper 42 is attached to the body 44 with a piece of material 50. The material 50 may be cloth, leather, polyester, etc. or any known material providing the desired strength, wear, weight, and aesthetic properties.

Material 50 is cut to have two opposed raw edges 52, 54 spaced sufficiently apart such that, when folded along fold line 56, the material 50 forms a double layer of material 58 of a desired length. That length is unique for any particular case design in order to space the zipper 42 apart from the body 44 by a desired distance depending upon the desired size of the interior volume 60 of the case 40 which is at least partially defined by the zipper 42 and material 50.

When assembling case 40, the opposed edges 52, 54 of material 50 are attached to respective top 62 and bottom 64 surfaces of tape 48. Attaching both of the opposed edges 52, 54 of material 50 to the tape 48 creates the double layer of the material 58 extending away from the zipper 42. The attachment may be made with a first stitch line or set of stitching 66, or may be made with any other known joining process, such as with an adhesive, ultrasonic welding, laser stitching, etc. Any known type of stitch may be used. One or both of the raw edges 52, 54 may be folded under to create a respective clean top edge 68 and clean bottom edge 70 in order to improve the appearance of the final product and to protect the raw edges 52, 54 from wear during use of the case 40. The attachment of material 50 to the tape 48 may be reinforced with a second similar or different type of attachment, such as with a second set of stitching 72 of the same or a different type of stitch or any other form of attachment.

The double layer of material 58 is attached to the body 44 along the fold line 56 remote from the zipper 42 to at least partially define an interior volume 60 of the case 40. The interior volume 60 may be the main compartment of the case or it may be a sub-compartment such as an interior or exterior pocket. This attachment may be made using a single set of stitching 74 or other form of attachment.

Figure 1:
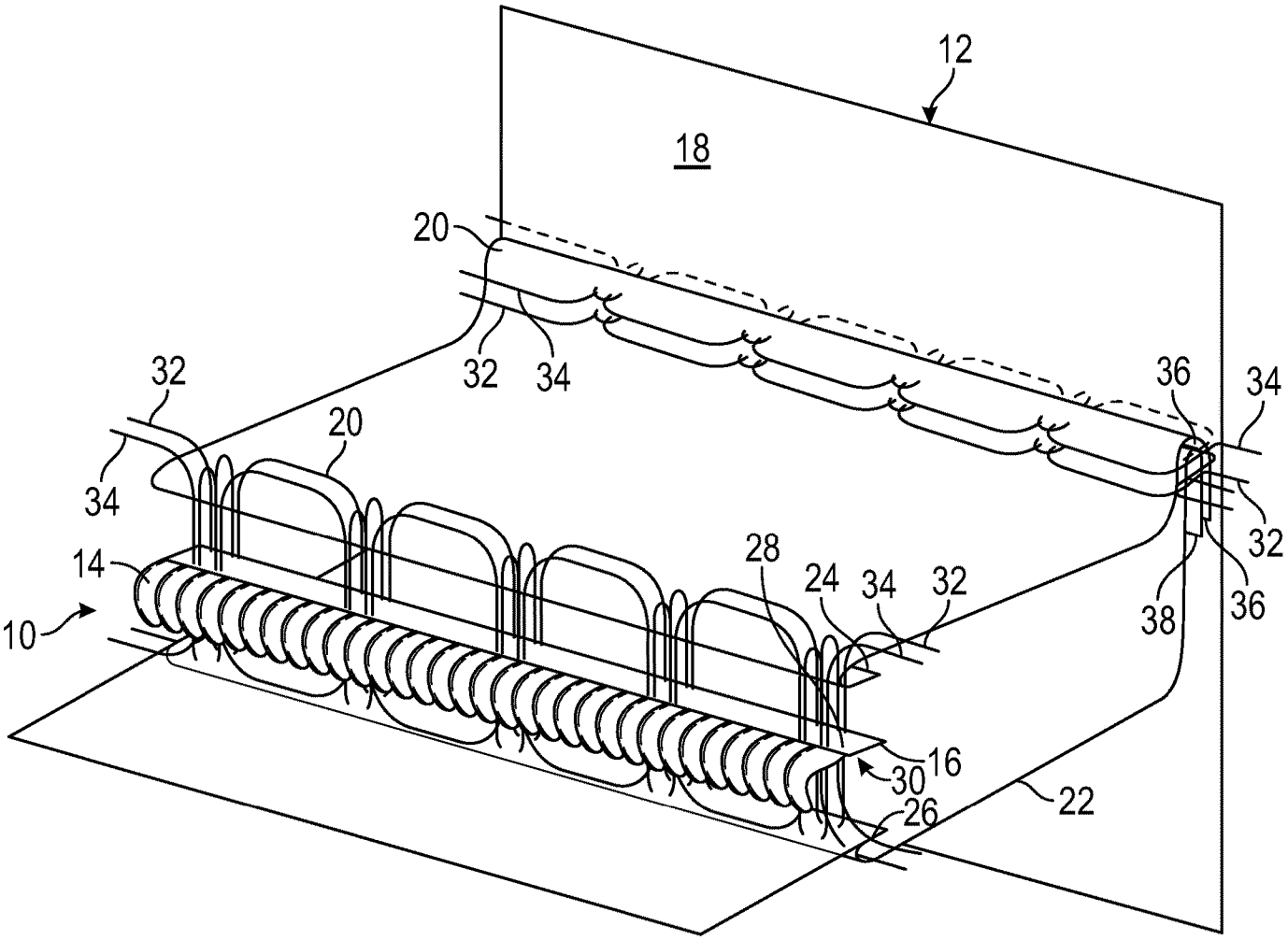
FIG. 1 (Prior Art)
FIG. 1 illustrates a prior art method of attaching a zipper to a case.

Advantageously, the attachment of the double layer of material 58 along fold line 56 results in no raw edge being exposed to the interior volume 60 of the case 40, thereby eliminating a potential failure mode that is present in the case 12 of FIG. 1. Moreover, the folded single piece of material 50 is stronger and provides improved resistance to the stress of use than do the two stitched together pieces of material 20, 22 of the prior art. In addition, the cost of manufacturing a carrying case 40 in accordance with the present invention is reduced when compared to a prior art case 12 due to the reduced number of cutting and joining steps.

While various embodiments of the present invention have been shown and described herein, it will be obvious that such embodiments are provided by way of example only. Numerous variations, changes in the order of steps, and substitutions may be made without departing from the invention herein.

What is claimed is:

1. A method of attaching a zipper to a case, the method comprising:

providing a single piece of material having opposed first and second raw edges;

folding the first raw edge of the material to create a clean top edge;

folding the second raw edge of the material to create a clean bottom edge;

attaching the clean top edge to a top surface of a tape of a zipper and the clean bottom edge to a bottom surface of the tape of the zipper, thereby creating a double layer of the material extending away from the zipper;

folding the double layer of material along a fold line remote from the zipper; and attaching the double layer of material to a body of a case proximate the fold line to at least partially define an interior volume of the case.

2. The method of claim 1, further comprising attaching the clean top edge to the top surface of the tape of the zipper and the clean bottom edge to the bottom surface of the tape of the zipper with a single set of stitching.

3. The method of claim 2, further comprising attaching the double layer of material to the body of the case with a single set of stitching proximate the fold line.

4. The method of claim 3, further comprising reinforcing the single set of stitching that attaches the clean top edge to the top surface of the tape and the clean bottom edge to the bottom surface of the tape with a second set of stitching.

5. The method of claim 1, further comprising attaching the double layer of material to the body of the case with a single set of stitching proximate the fold line.

6. The method of claim 4 used to attach the zipper to the case to at least partially define a pocket on the case.

7. A method of attaching a zipper to a carrying case, the method comprising:

attaching opposed edges of a single piece of material to respective top and bottom surfaces of a tape of a zipper to form a double layer of the material extending away from the zipper;

folding the double layer of material along a fold line remote from the zipper; and attaching the double layer of material to a wall of a carrying case along the fold line.

8. The method of claim 7, further comprising attaching the opposed edges of the single piece of material to the respective top and bottom surfaces of the tape of the zipper using a single set of stitching.

9. The method of claim 8, further comprising attaching the double layer of material to the wall of the carrying case using a single set of stitching along the fold line.

10. The method of claim 9, further comprising reinforcing the single set of stitching that attaches the opposed edges of the single piece of material to the respective top and bottom surfaces of the tape with a second set of stitching.

11. The method of claim 10, further comprising folding the opposed respective edges of the single piece of material to form respective clean edges prior to the step of attaching the opposed edges of the single piece of material to the respective top and bottom surfaces of the tape of the zipper using a single set of stitching.

12. The method of claim 7, further comprising attaching the double layer of material to the wall of the carrying case using a single set of stitching along the fold line.

13. The method of claim 11 used to attach the zipper to the carrying case to at least partially define a pocket on the carrying case.

14. A carrying case formed using the method of claim 4.

15. A carrying case having at least one compartment closed by a zipper and made by a method comprising:

attaching opposed edges of a single piece of material to respective top and bottom surfaces of a tape of a zipper to form a double layer of the material extending away from the zipper;

folding the double layer of material along a fold line remote from the zipper;

attaching the double layer of material to the wall of the carrying case using a single set of stitching along the fold line;

reinforcing the single set of stitching that attaches the opposed edges of the single piece of material to the respective top and bottom surfaces of the tape with a second set of stitching; and folding the opposed respective edges of the single piece of material to form respective clean edges prior to the step of attaching the opposed edges of the single piece of material to the respective top and bottom surfaces of the tape of the zipper using a single set of stitching.

* * * * *